US010184288B2

(12) United States Patent
Blijweert

(10) Patent No.: US 10,184,288 B2
(45) Date of Patent: Jan. 22, 2019

(54) PLASTIC THERMAL BARRIER, COMPOSITE PROFILE AND WINDOW THAT COMPRISE SUCH A THERMAL BARRIER AND METHOD FOR PRODUCING A FRAME FOR A WINDOW

(71) Applicant: ALUK, SOCIETE ANONYME, Luxembourg (LU)

(72) Inventor: Peter Blijweert, Waasmunster (BE)

(73) Assignee: ALUK, SOCIETE ANONYME, Luxembourg (LU)

( * ) Notice: Subject to any disclaimer, the term of this patent is extended or adjusted under 35 U.S.C. 154(b) by 7 days.

(21) Appl. No.: 15/106,707

(22) PCT Filed: Dec. 17, 2014

(86) PCT No.: PCT/IB2014/002804

§ 371 (c)(1),
(2) Date: Jun. 20, 2016

(87) PCT Pub. No.: WO2015/092526

PCT Pub. Date: Jun. 25, 2015

(65) Prior Publication Data

US 2016/0312519 A1 Oct. 27, 2016

(30) Foreign Application Priority Data

Dec. 20, 2013 (BE) ..... 2013/0866

(51) Int. Cl.
*E06B 1/18* (2006.01)
*E06B 3/263* (2006.01)
(Continued)

(52) U.S. Cl.
CPC ..... *E06B 1/18* (2013.01); *E06B 1/16* (2013.01); *E06B 3/26303* (2013.01);
(Continued)

(58) Field of Classification Search
CPC ..... E06B 1/18; E06B 1/16; E06B 3/26303; E06B 3/5409; E06B 2003/26352; E06B 2003/26389
(Continued)

(56) References Cited

U.S. PATENT DOCUMENTS 3,908,313 A * 9/1975 Bierlich ..... E06B 3/26301 49/501
4,184,297 A * 1/1980 Casamayor ..... E06B 3/28 52/202
(Continued)

FOREIGN PATENT DOCUMENTS

CN 200985709 Y 12/2007
CN 201412025 Y 2/2010
(Continued)

OTHER PUBLICATIONS

International Search Report dated Mar. 30, 2015 re: Application No. PCT/IB2014/002804; pp. 1-4; citing: WO 2013/178368 A1, DE 20 2012 010135 U1, FR 2 938 594 A1, FR 2 951 766 A1 and DE 20 2013 100101 U1.
(Continued)

*Primary Examiner* — Brian E Glessner
*Assistant Examiner* — Adam G Barlow
(74) *Attorney, Agent, or Firm* — Cantor Colburn LLP

(57) ABSTRACT

A plastic thermal barrier connects an inner shell and an outer shell of a window frame or a door frame. The thermal barrier includes a first part that is provided with a component for connecting it to an inner shell and an outer shell. The thermal barrier further includes a second part, whereby these parts are connected to one another in a hinged way by means of a film hinge and are provided with mutually complementary elements of a snap connector configured to fasten the two parts together.

15 Claims, 9 Drawing Sheets

(51) Int. Cl.
*E06B 3/54* (2006.01)
*E06B 1/16* (2006.01)

(52) U.S. Cl.
CPC .. *E06B 3/5409* (2013.01); *E06B 2003/26352* (2013.01); *E06B 2003/26389* (2013.01)

(58) Field of Classification Search
USPC ..... 52/396.01, 404.1, 407.1, 501, 504; 49/501, 504, DIG. 1
See application file for complete search history.

(56) References Cited

U.S. PATENT DOCUMENTS 4,344,254 A * 8/1982 Varlonga ..... E06B 3/308 49/401
4,524,112 A * 6/1985 Willert ..... E06B 3/273 428/595
4,569,170 A * 2/1986 Gartner ..... E06B 1/6007 49/DIG. 1
4,614,062 A * 9/1986 Sperr ..... E06B 3/26303 49/401
4,616,460 A * 10/1986 Nicholas ..... E04B 1/6815 277/644
5,768,836 A * 6/1998 Bachmann ..... E06B 1/325 49/504
6,035,596 A * 3/2000 Brunnhofer ..... E06B 3/26303 49/DIG. 1
6,058,657 A * 5/2000 Merla ..... F25D 23/087 49/478.1
6,202,353 B1 * 3/2001 Giacomelli ..... E06B 3/2632 49/504
7,104,019 B2 * 9/2006 Brunnhofer ..... E06B 3/2632 52/309.9
D565,200 S * 3/2008 Saito ..... D25/122
7,987,633 B2 * 8/2011 Lenox ..... E06B 3/26303 49/504
8,322,090 B2 * 12/2012 Moriya ..... E06B 7/10 52/204.591
9,127,498 B1 * 9/2015 Ye ..... E06B 3/24
2004/0139661 A1 * 7/2004 Cittadini ..... E05C 19/161 49/489.1
2006/0248820 A1 * 11/2006 Silverman ..... E06B 3/5871 52/204.1
2010/0001164 A1 * 1/2010 Wear ..... A47G 1/0611 248/475.1
2011/0011028 A1 * 1/2011 Rawlings ..... E06B 3/26303 52/656.5
2014/0053488 A1 * 2/2014 Lenox ..... E06B 3/26303 52/404.1
2016/0237735 A1 * 8/2016 Rawlings ..... E06B 3/26303
2016/0312519 A1 * 10/2016 Blijweert ..... E06B 3/26303

FOREIGN PATENT DOCUMENTS

DE 202012010135 U1 11/2012
DE 202013100101 U1 2/2013
EP 2374977 * 12/2011
FR 2938594 A1 5/2010
FR 2951766 A1 4/2011
WO 2013178368 A1 12/2013
WO WO 2013178368 A1 * 12/2013 ..... E06B 3/26305

OTHER PUBLICATIONS

Written Opinion dated Mar. 30, 2015 re: Application No. PCT/IB2014/002804; pp. 1-4; citing: WO 2013/178368 A1, DE 20 2012 010135 U1, FR 2 938 594 A1, FR 2 951 766 A1 and DE 20 2013 100101 U1.

* cited by examiner

PLASTIC THERMAL BARRIER, COMPOSITE PROFILE AND WINDOW THAT COMPRISE SUCH A THERMAL BARRIER AND METHOD FOR PRODUCING A FRAME FOR A WINDOW

TECHNICAL FIELD

The present disclosure relates to a plastic thermal barrier, a composite profile and a window that comprise such a thermal barrier and a method for producing a frame for a window.

BACKGROUND

It is known to make window frames from aluminium or aluminium alloy. To this end, traditionally an outer shell and an inner shell of aluminium or aluminium alloy are connected together by means of a number, mostly two, of thermal barriers.

The thermal barriers primarily have a mechanical function to connect the inner shell and outer shell together and are thus of great structural importance. This means that they must be made of hard rigid plastic.

The outer shell, inner shell and thermal barriers are formed as profiles, whereby a composite profile is formed after these components are connected together.

Such a composite profile is then further processed by a window manufacturer into a window of the desired size, whereby the window manufacturer saws the composite profile to the desired lengths in order to produce the window.

In order to obtain good thermal insulation, open spaces in a window are filled with a thermal insulation as much as possible. This generally includes a foam body or a structured hollow body that is provided with partitions so that relatively small chambers are formed and can greatly reduce the heat transfer between the inside and outside of the window by the convection of air in these spaces.

Such spaces are the space between a glass panel and a frame in which this glass panel is supported on the one hand, and on the other hand the space between a fixed frame and a sash that must be able to move with respect to one another.

These spaces are located next to a thermal barrier and it would also be attractive to be able to integrate a thermal insulation in a thermal barrier, because the thermal insulation is immediately affixed when assembling the composite profile, such that considerable cost benefits can be achieved.

However this is not done for a number of reasons.

Firstly it would lead to problems when fitting glass supports.

Because the thermal barriers do not have sufficient strength, sturdy glass supports have to be provided in a frame in a number of places that form a bridge between the inner shell and outer shell, so that a glass panel is supported on the inner shell and outer shell via the glass support.

If a thermal insulation is now integrated with a thermal barrier, a part of this extended thermal barrier, i.e. the part that corresponds to the part that forms the thermal insulation, must be selectively removed at the places where a glass support has to be placed.

As in such a composite profile there is no, or only very limited, access from the side to the part of the extended thermal barrier that forms the thermal insulation, in practice this is not done, in any case not without the risk of damaging the thermal barrier itself and thereby jeopardising the structural strength of the frame.

Secondly such a part of the extended thermal barrier can be damaged relatively easily during the transport of the composite profiles.

Thirdly such an integration of a thermal insulation with a thermal barrier gives the disadvantage that the flexibility of the use of the composite profiles is limited.

Although not necessary for reasons of heat transfer by means of convection, in some cases it can nevertheless be desirable to provide a rebate gasket that ensures the windproofing and waterproofing of a window instead of, or together with, a body to fill a space.

However, when a thermal insulation is integrated with a thermal barrier the design of the insulation is already fixed during the production of the composite profile such that it can no longer be adjusted, and the flexibility of a window manufacturer to use another insulation is taken away.

In view of the above disadvantages, composite profiles in which a thermal insulation is integrated in an insulating set are not supplied by suppliers of composite profiles.

Instead of this the window manufacturer first places the glass supports in the desired place, then determines the necessary lengths and types of the thermal insulations, makes them to the desired size from longer pieces and affixes them on the composite profiles, generally on the thermal barriers thereof.

As already noted above this requires a lot of work so that the construction of windows is expensive.

SUMMARY

The purpose of the present disclosure is to provide a solution to the aforementioned and other disadvantages by providing a plastic thermal barrier to connect an inner shell and an outer shell of a window frame or a door frame together, whereby the thermal barrier comprises a first part that is provided with means to connect it to an inner shell and an outer shell, and comprises a second part, whereby these parts are connected to one another in a hinged way by means of a film hinge and are provided with mutually complementary elements of a snap connector to be able to fasten the two parts together.

Such a thermal barrier enables parts of the second part to be easily removed in order to place glass supports in these places, because such a snap connector can be opened again and such a film hinge is mechanically weak and can be torn through, or is easily accessible to be cut through.

This thus indirectly enables a thermal insulation to be fully integrated in a thermal barrier and this thermal insulation is thus already affixed during the production of the composite profile.

As a result of the easy removability of the second part, any transport damage can also be easily repaired by completely removing a damaged part from the second part and replacing it with a replacement part specially designed for that purpose.

If desired this second part can be easily removed and replaced by an extension piece that forms a different type of seal or a seal that has a different geometry.

In a preferred embodiment, when both parts are snapped together, the thermal barrier is provided with one or more insulating chambers, whereby at least one insulating chamber has at least one wall that is formed by the first part and at least one wall that is formed by the second part.

As a result at least one insulating chamber is only formed in a situation in which both parts are snapped together.

In another preferred embodiment, the film hinge is produced from a different material to the first part, whereby preferably the first part is made of ABS and preferably the film hinge is made of TPE, i.e. a thermoplastic elastomer.

These materials can be easily worked and have the right properties.

In another preferred embodiment the thermal barrier is produced by means of coextrusion of the first part and the second part and the film hinge, and preferably in an orientation in which the first and second part are not connected by means of the snap connector.

This is a practical way of producing such a thermal barrier, whereby due to the fact that the parts are not snapped together the coextrusion is easier to perform, especially with regard to the prevention of sizes and geometries that are outside the tolerances. In this orientation there is no risk of the elements of the snap connector fusing together.

The disclosure further concerns a composite profile for making a window frame or door frame, whereby the composite profile comprises an inner shell and an outer shell that are connected together by means of at least one thermal barrier according to the disclosure.

The disclosure further concerns a window that comprises a fixed frame and a movable sash in the fixed frame, whereby both the fixed frame and the sash are made from a composite profile as mentioned above.

The disclosure also concerns a method for producing a frame for a window, whereby this frame comprises an inner edge that is provided with one or more glass supports and an insulating seal that is on the parts of the inner edge where there is no glass support, whereby in a first step an insulating seal is provided around the entire inner edge and in a second step sections are removed from the insulating seal to make space for the glass supports.

This has the advantage that the amount of operations that must be done are far fewer than with the known methods.

BRIEF DESCRIPTION OF THE DRAWINGS

With the intention of better showing the characteristics of the disclosure, a preferred embodiment of a window according to the disclosure is described hereinafter by way of an example, without any limiting nature, with reference to the accompanying drawings, wherein.

DETAILED DESCRIPTION OF THE DRAWINGS

Figure 1:
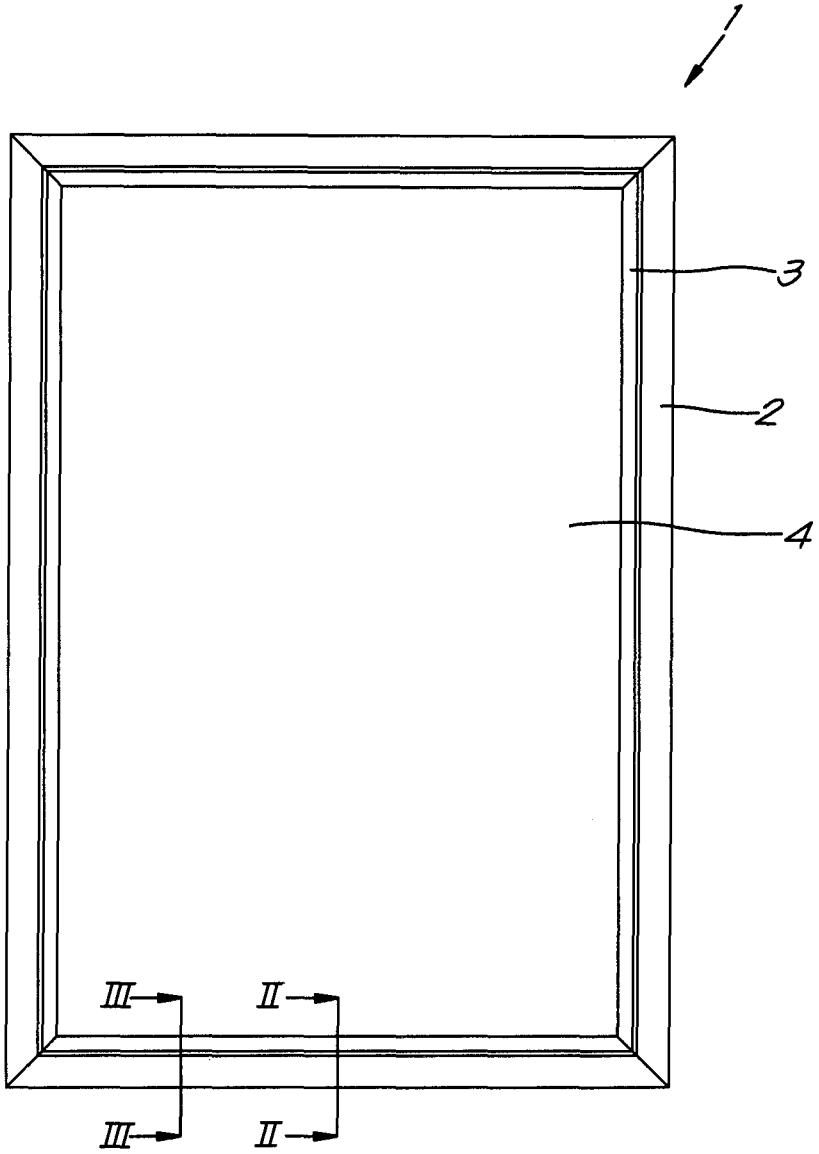
FIG. 1 schematically shows a front view of a window according to the disclosure.
Figure 2:
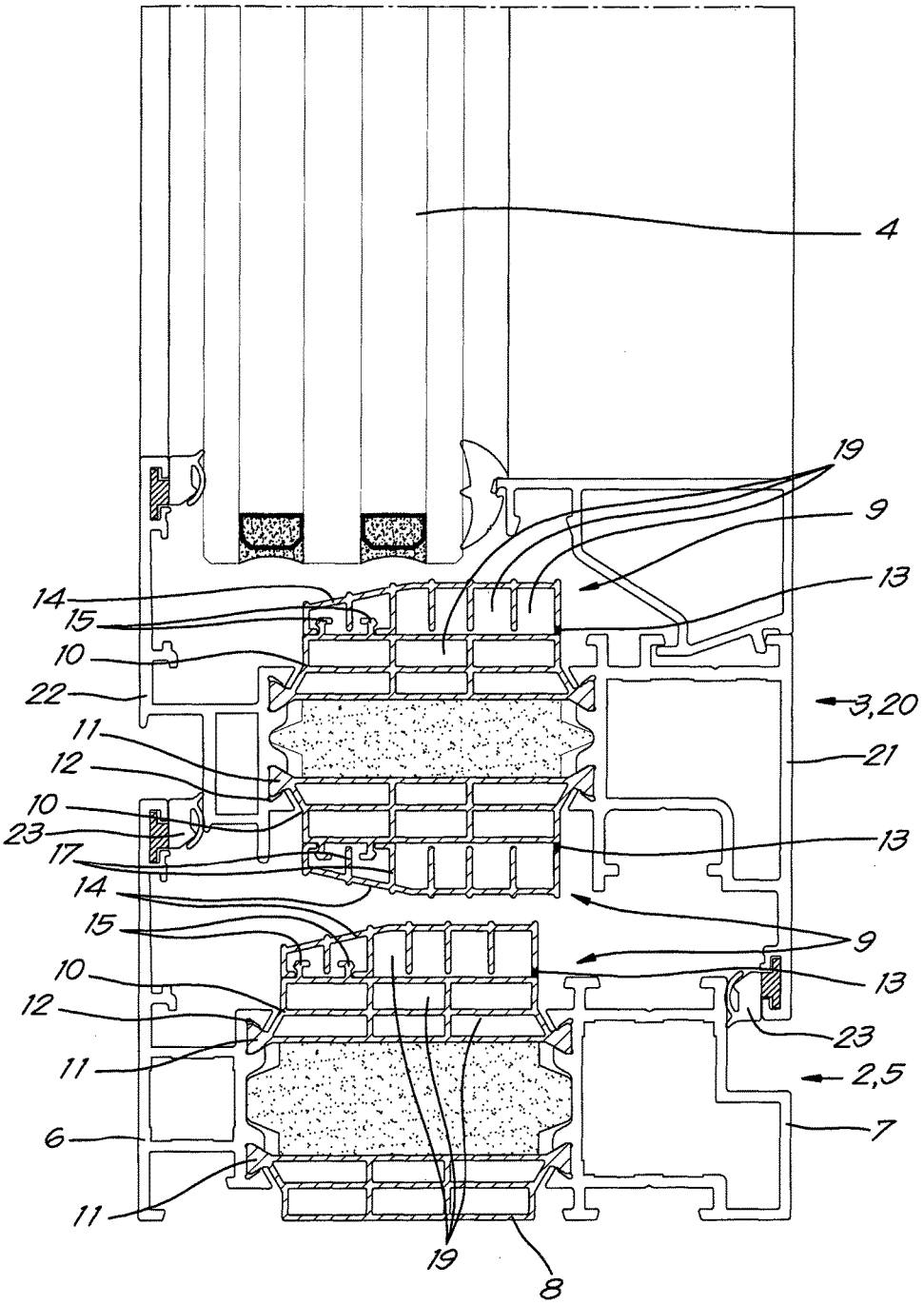
FIG. 2 shows a cross-section of the window of FIG. 1 according to line II-II.
Figure 3:
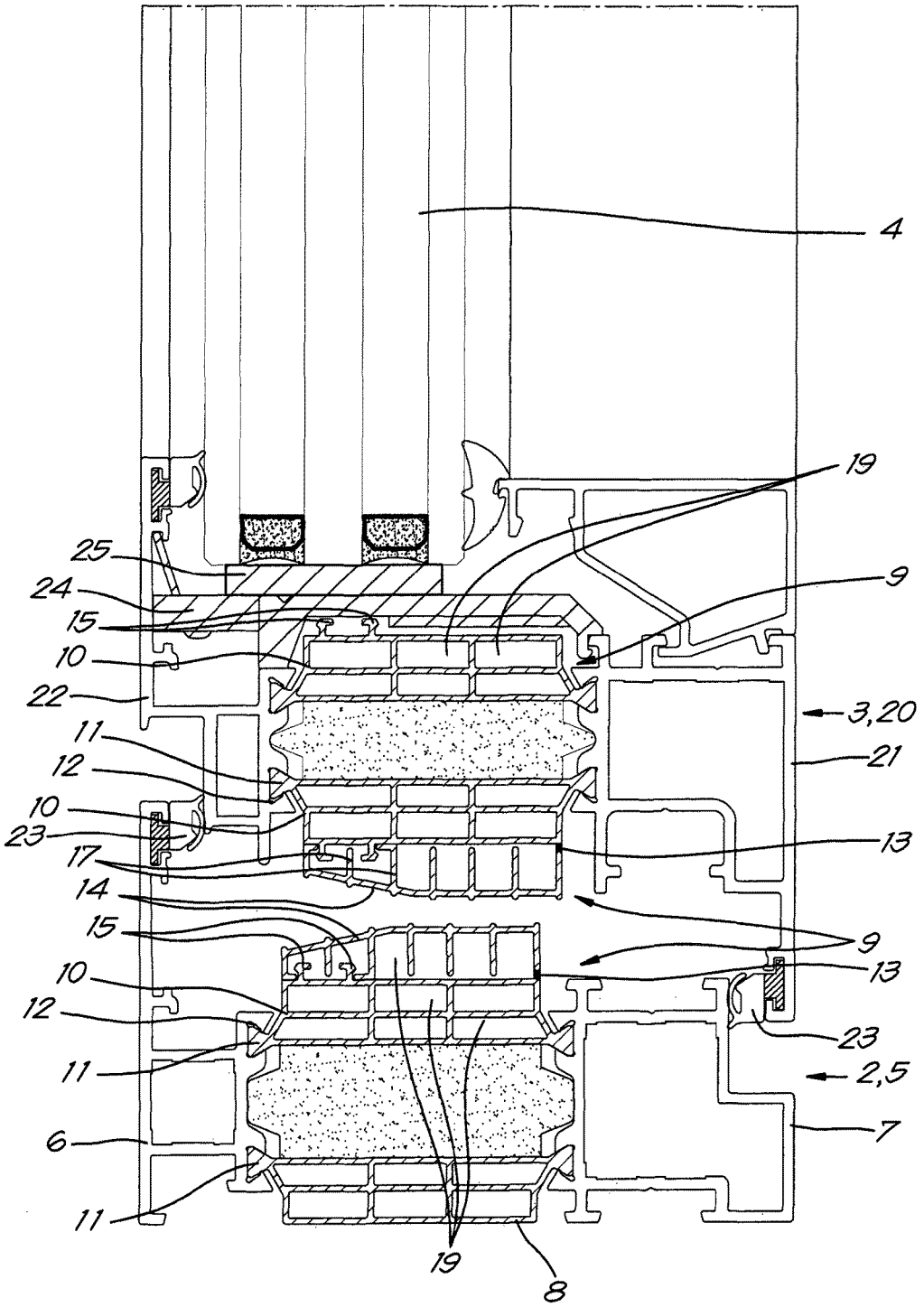
FIG. 3 shows a cross-section of the window of FIG. 1 according to line III-III.

The window 1 shown in FIGS. 1 to 3 comprises a fixed frame 2 and a sash 3. A glass panel 4 is placed in the sash 3.

The fixed frame 2 is made from a composite profile 5 that essentially comprises an aluminium outer shell 6 and an aluminium inner shell 7 that are connected together by means of two thermal barriers. Here the bottom thermal barrier is a traditional one-piece thermal barrier 8.

Figure 4:
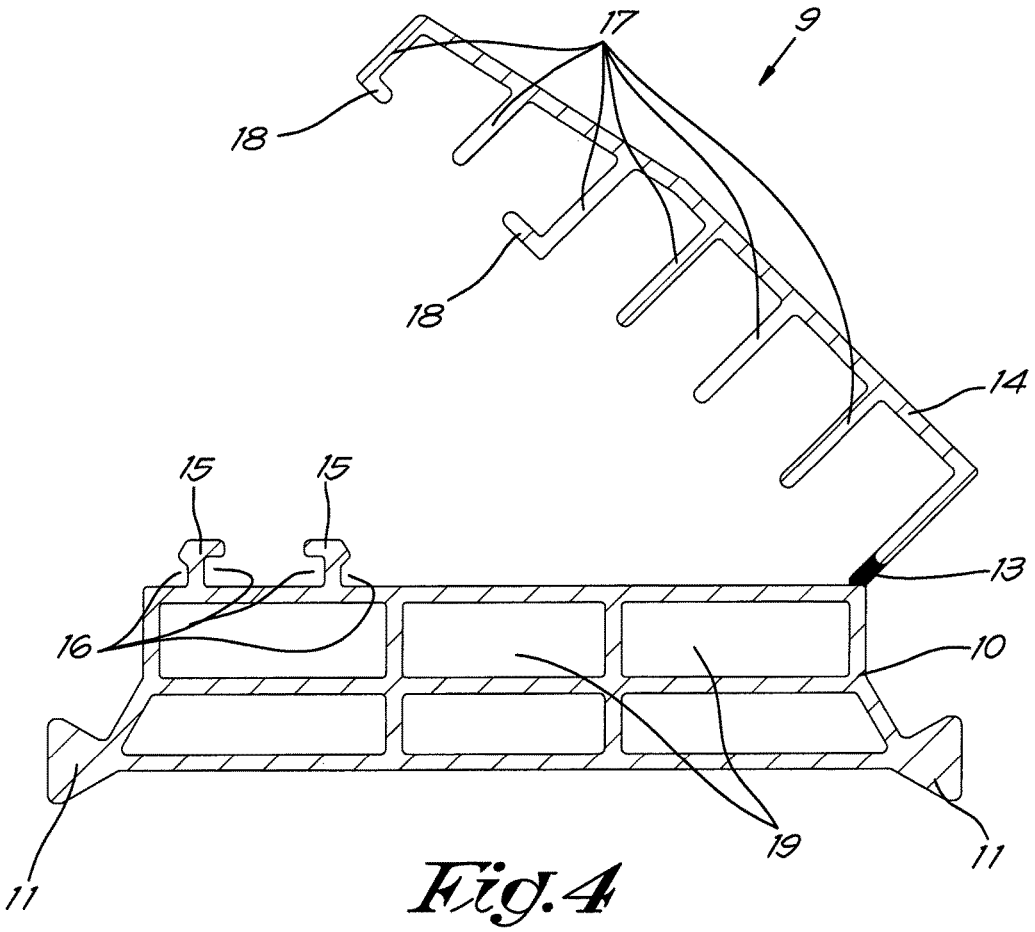
FIG. 4 shows a component of the window of FIG. 1 on a larger scale.

The top thermal barrier is a two-piece thermal barrier 9, as shown in more detail in FIG. 4 on a larger scale.

The two-piece thermal barrier 9 comprises a first part 10, made of ABS, that is provided with widened triangular heads 11 with which the two-piece thermal barrier 9 is wedged in grooves 12 in the inner shell 7 and outer shell 6.

A thin strip 13 of TPE, thermoplastic elastomer is fastened on the first part 10. A second part 14 of the two-piece thermal barrier 9, that is also made of ABS, is fastened to this strip 13 of TPE.

Thanks to the strip 13 of TPE, that forms a film hinge, the first part 10 and the second part 14 can move with respect one another.

The first part 10 is constructed with two upright edges 15 that are provided with an undercut 16 on their sides turned towards one another, and on their sides turned away from one another.

The second part 14 is constructed with six upright edges 17. Two of them have a perpendicular widening 18 at the end, whereby the widening 18 goes in the undercut 16 of the upright edges 15 of the first part 10, so that the second part 14 and the first part 10 can be snapped together and the upright edges 15, 17 form complementary elements of a snap connector.

The two-piece thermal barrier 9 is provided internally with a number of walls that define a number of insulating chambers 19, so that this thermal barrier 9 acts as a thermal insulation. These walls are partly formed by the aforementioned upright edges 17.

Part of the insulating chambers 19, more specifically the top row of insulating chambers 19 in FIGS. 2 and 3, are partly formed by walls that form part of the first part 10 and partly by walls that form part of the second part 14.

The sash 3 is also made from a composite profile 20 that essentially comprises an aluminium inner shell 21 and an aluminium outer shell 22, that are connected together by two thermal barriers.

In this case both thermal barriers are two-piece thermal barriers 9, identical to the two-piece thermal barrier 9 described above.

The window 1 is provided with the necessary rebate gaskets 23 to guarantee waterproofing and windproofing.

As is especially clear from FIG. 3, the glass panel 4 is supported by supporting blocks 24, which in turn are placed on glass supports 25.

These glass supports 25 are supported by both the inner shell 21 and the outer shell 22 of the sash 3.

At the location of the glass supports 25 the second part 14 of the thermal barrier 9 is removed. The second part 14 of the thermal barrier 9 is indeed present in the rest of the inner edge of the sash 3.

A window 1 described above can be produced as follows.

First outer shells 6,22, inner shells 7,21, rebate gaskets and one-piece thermal barriers 8 are produced in a traditional way, all as long profiles.

Two-piece thermal barriers are also produced as long profiles. This is done in one production stage by means of coextrusion of the first part 10, the second part 14, and the strip of TPE 13.

Hereby a two-piece thermal barrier 9 is produced in a state in which the snap connector is not snapped closed, as shown in FIG. 4.

The said profiles are then connected to one another so that composite profiles 5,20 are formed for the fixed frame 2 and for the sash 3.

The fixed frame 2 can now be produced by sawing off lengths of the desired size of the composite profile 5 concerned and fastening them together.

In a first step the sash 3 can be produced in this way from the composite profile 20 for the sash 3.

Figure 5:
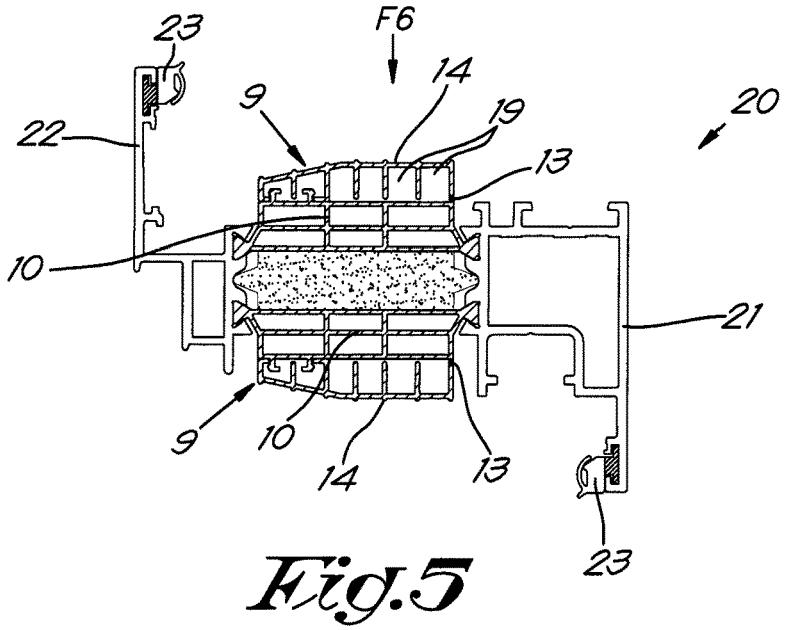
FIG. 5 shows a step in the production of the window of FIG. 1 in a cross-section that corresponds to FIG. 3.
Figure 6:
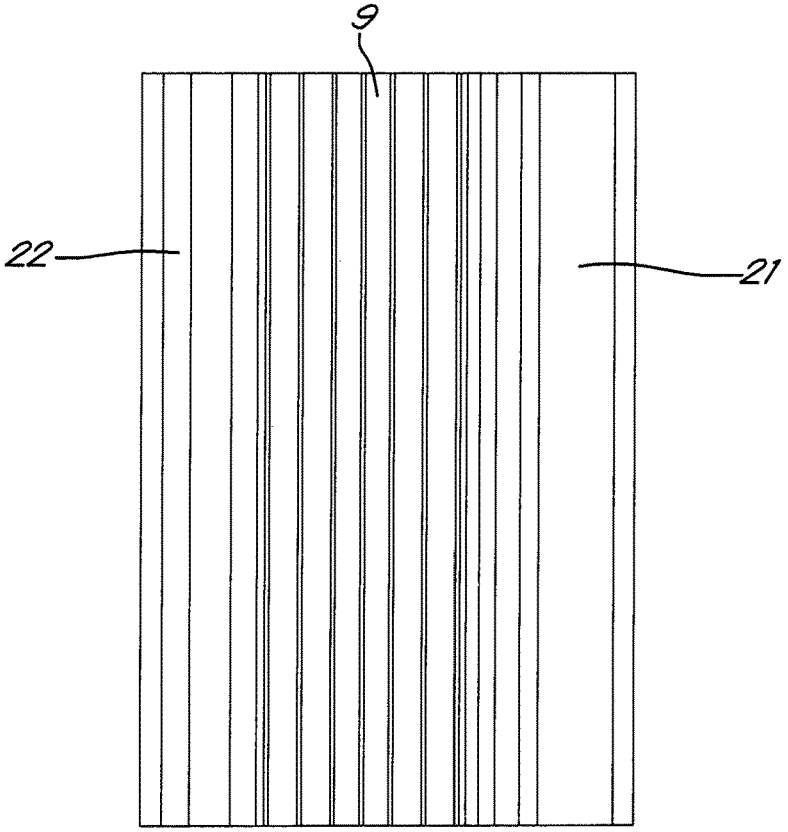
FIG. 6 shows a top view according to F6 of the partially produced window of FIG. 5.

Such a composite profile 20 as a component of a sash 3 is shown in FIGS. 5 and 6.

The glass supports 25 are then affixed in the sash 3 by providing, at the places where a glass support 25 has to be placed, the second part 14 of the inner two-piece thermal barrier 9 with cuts 26 perpendicular to the direction in which this thermal barrier 9 extends.

These cuts 26 run up to the first part 10 of the two-piece thermal barrier, and can for example be made by means of a handsaw for plastic or a milling cutter.

Figure 7:
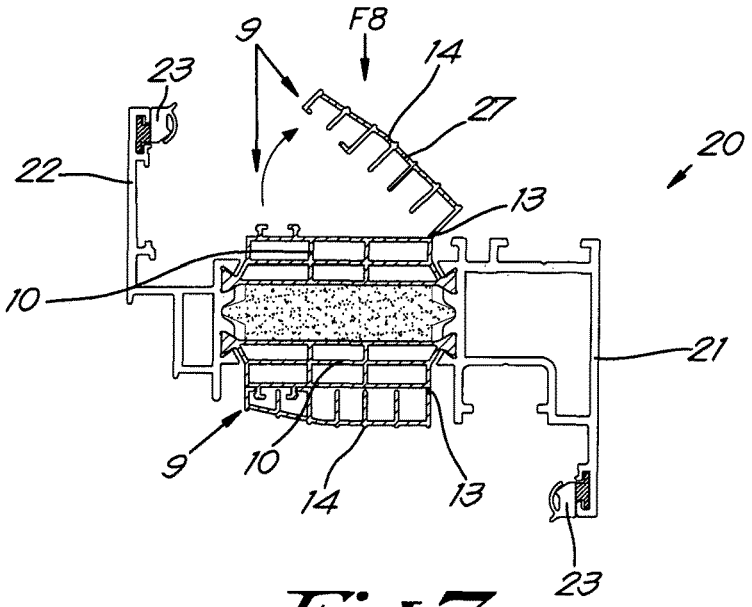
FIGS. 7 to 12 show further steps in the production of the window of FIG. 1, in presentations that correspond to those of FIGS. 5 and 6 respectively.
Figure 8:
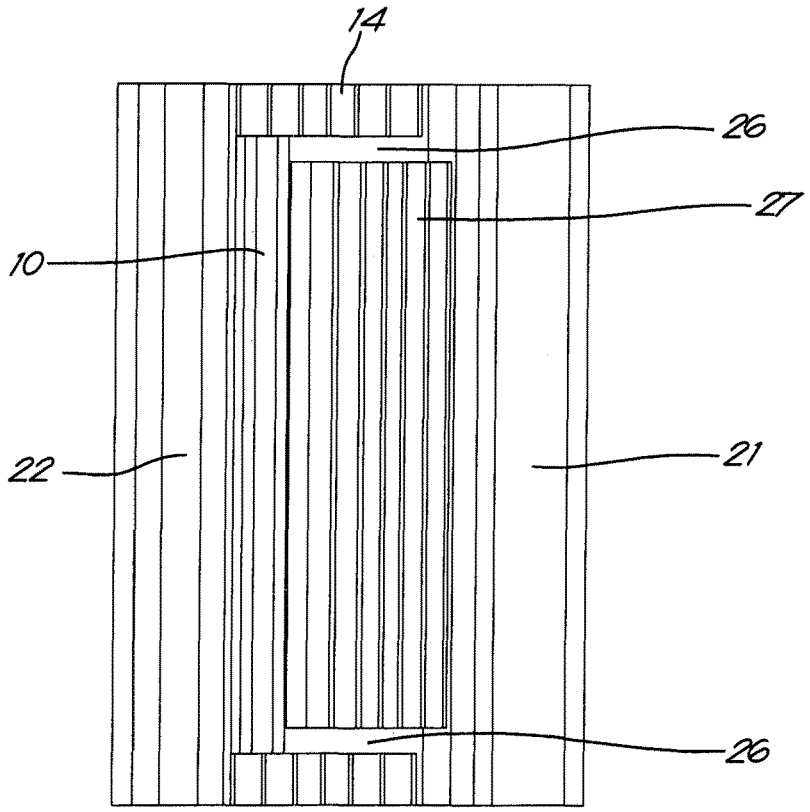

Then the snap connector of the section 27 of the second part 14 can easily be released between the cuts 26, and this section 27 can be lifted up while it is still fastened to the first part 10 via the strip 13 of TPE, thus via the film hinge, as shown in FIGS. 7 and 8.

Figure 9:
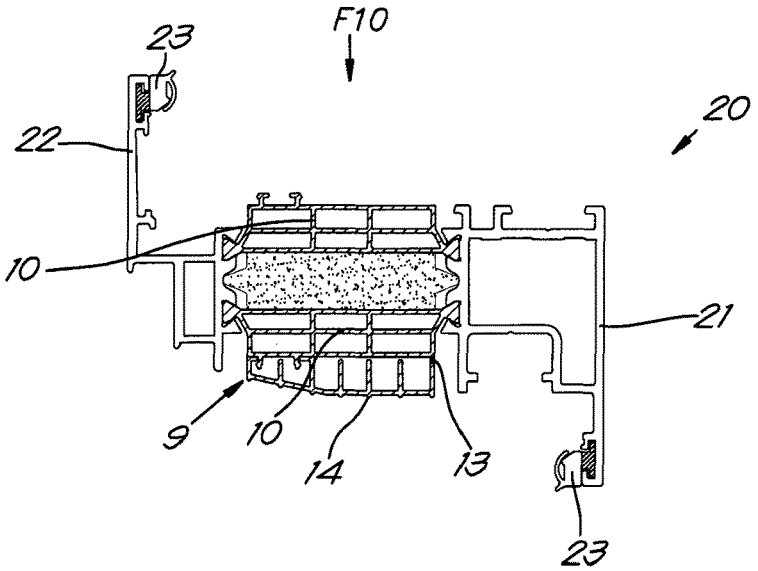
Figure 10:
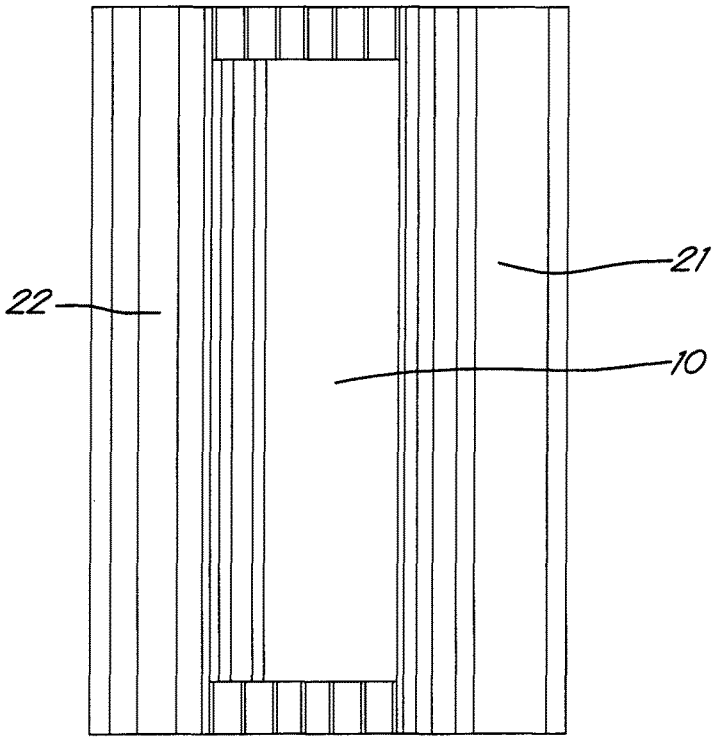

Then the film hinge between the cuts 26 is cut through with a knife or simply torn through by tugging on the said section 27 of the second part 14. As a result the situation as shown in FIGS. 9 and 10 is obtained.

Figure 11:
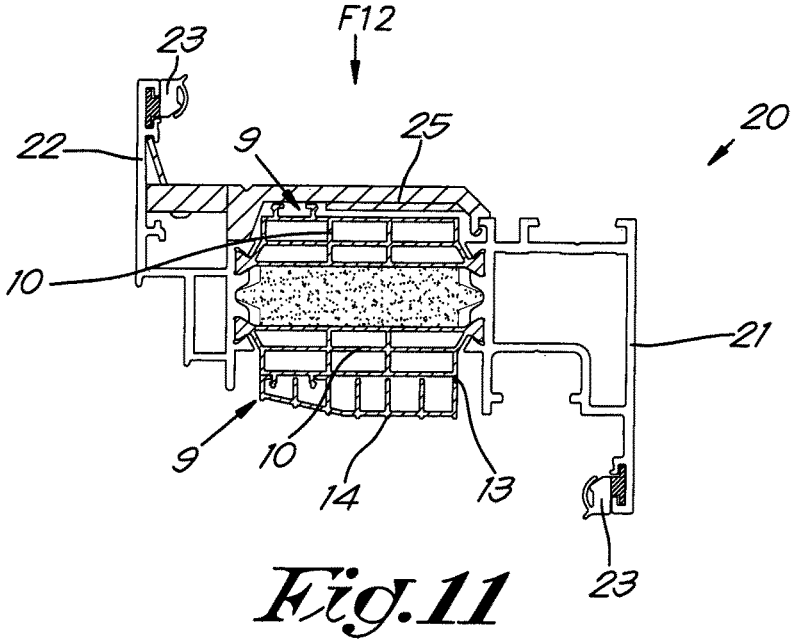
Figure 12:
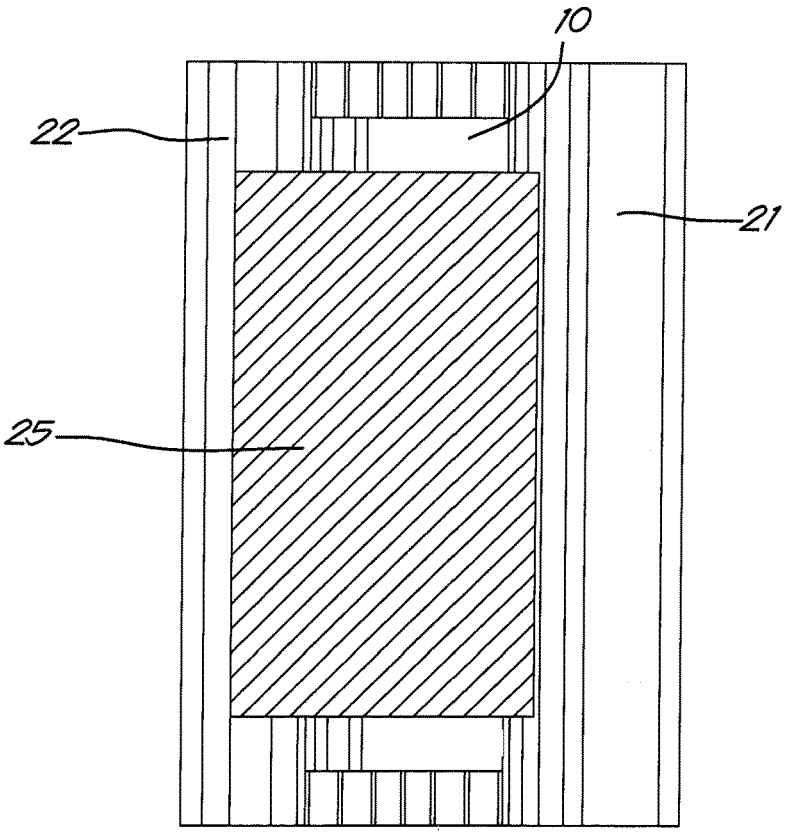

Then a glass support 25 can be fitted as shown in FIGS. 11 and 12.

The sash 3 can now be provided with supporting blocks 24 and a glass panel 4 in a traditional way.

Figure 13:
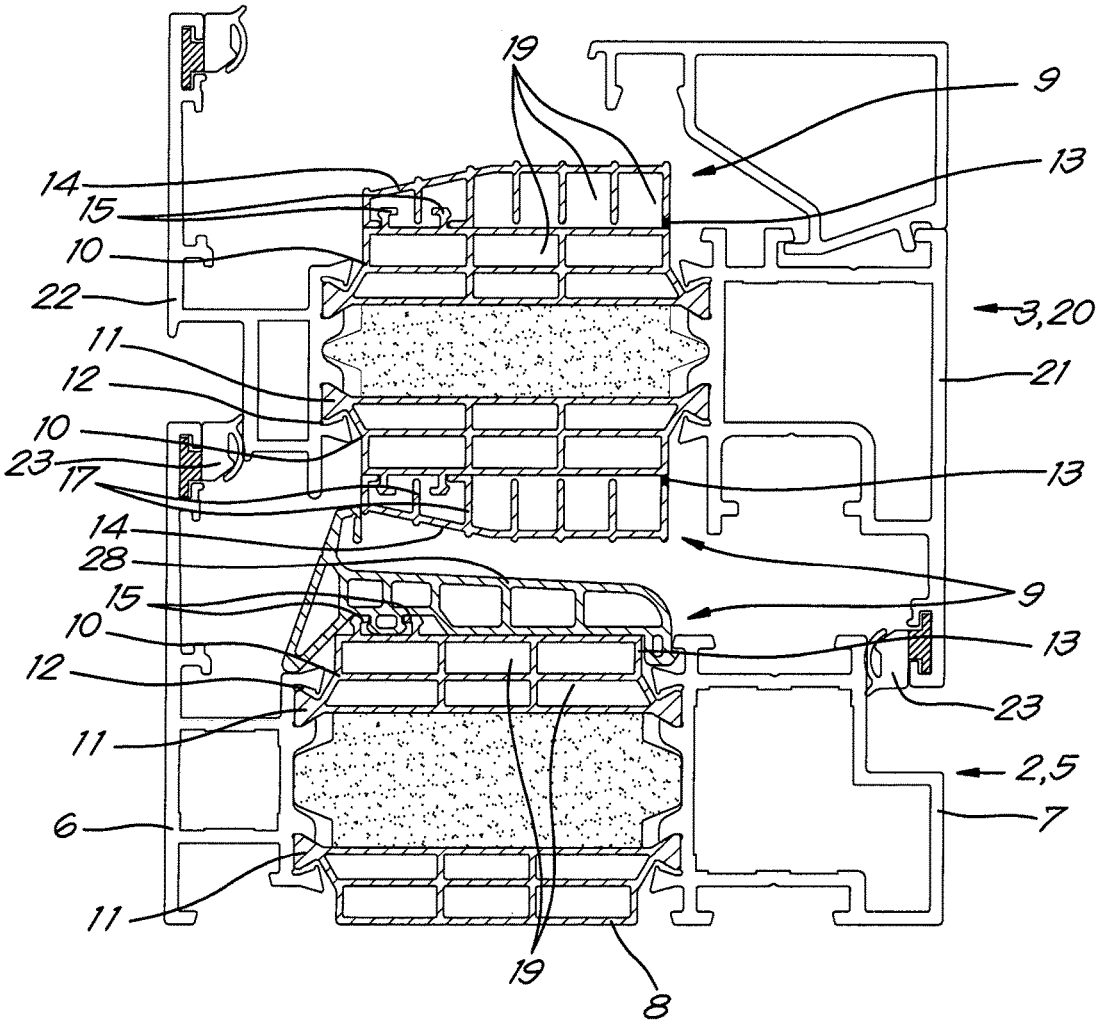
FIG. 13 shows a cross-section of an alternative window according to the disclosure.

The alternative embodiment shown in FIG. 13 differs from the above window 1 because the second part 14 of the two-piece thermal barrier 9 placed there is removed and replaced over the entire inner edge of the fixed frame 2 by an alternative second part 28 that comprises a rebate gasket. This alternative second part 28 is snapped onto the first part 10 and the rest of the composite profile 5, but is not connected to the first part 10 via a film hinge.

Although not normally necessary, such an alternative embodiment can be requested by the purchaser of the window 1 in specific situations on request.

The present disclosure is by no means limited to the embodiments described as an example and shown in the drawings, but a thermal barrier, composite profile, and window according to the disclosure can be realized in all kinds of forms and dimensions without departing from the scope of the disclosure.

The invention claimed is:

1. A plastic thermal barrier with an integrated insulating seal, to connect an inner shell and an outer shell of a window frame or a door frame together, the thermal barrier comprising:

a first part configured to connect to the inner shell and the outer shell; and a second part, wherein the integrated insulating seal is at least partly formed by the second part of the thermal barrier;

wherein the first part is connected to the second part by means of a film hinge and the first and second parts are provided with mutually complementary elements of a snap connector to fasten the first and second parts together;

wherein the film hinge is disposed at a first end of the thermal barrier and the mutually complementary elements of the snap connector are disposed at an opposite second end of the thermal barrier;

wherein in a mounted state of the barrier between said inner and outer shells, the integrated insulating seal is situated in a space between a glass panel and the window frame or in a space between a fixed window frame and a moveable sash frame;

wherein the plastic thermal barrier further comprises a plurality of upright edges extending between the first part and the second part so as to delimit a plurality of compartments between the first and second parts, the compartments configured to reduce a convective loss of the thermal barrier, each of the plurality of upright edges being affixed to at least one of the first and second parts; and wherein the mutually complementary elements of the snap connector comprise at least one widening extending generally perpendicularly from a free end of at least one of said plurality of upright edges and a corresponding undercut disposed on the first or second part adjacent to said widening, the undercut being configured to engage and releasably retain the widening to said fasten the first and second parts together.

2. The thermal barrier according to claim 1, wherein the integrated insulating seal of the thermal barrier, when both parts are snapped together, is provided with one or more insulating chambers, wherein at least one insulating chamber has at least one wall that is formed by the first part and at least one wall that is formed by the second part.

3. The thermal barrier according to claim 1, wherein the means to connect the first part to an inner shell and an outer shell include a widened head on both sides of the thermal barrier to be wedged into a groove in the inner shell and outer shell, wherein the film hinge is made of a different material to the first part.

4. The thermal barrier according to claim 3, wherein the first part is made of ABS.

5. The thermal barrier according to claim 3, wherein the film hinge is made of TPE.

6. The thermal barrier according to claim 1, wherein the thermal barrier is produced by means of coextrusion of the first part and the second part and the film hinge.

7. The thermal barrier according to claim 6, wherein the thermal barrier is produced in an orientation in which the first part and second part are not connected by means of the snap connector.

8. A composite profile for making a window frame or door frame, wherein the composite profile comprises an inner shell and an outer shell that are connected together by means of at least one thermal barrier according to claim 1.

9. The composite profile according to claim 8, wherein the inner shell and the outer shell are made of aluminium or an aluminium alloy.

10. The composite profile according to claim 8, wherein the inner shell and the outer shell are connected together by means of two insulating courses (9), wherein the respective first parts of the two insulating courses (9) are turned towards one another.

11. A window that comprises a frame, wherein the frame is made from a composite profile according to claim 8.

12. The window according to claim 11, that comprises a fixed frame and a movable sash in the fixed frame, wherein both the fixed frame and the movable sash are made from a composite profile.

13. The window according to claim 12, wherein the fixed frame is made from a composite profile and the movable sash is made from a composite profile.

14. A method for producing a frame for a window, whereby the frame comprises an inner edge that is provided with one or more glass supports and a thermal insulating seal that is on the parts of the inner edge where there is no glass support, wherein in a first step a thermal insulating seal is provided around the entire inner edge and in a second step sections are removed from the insulating seal to make space for the glass supports, wherein the frame is made from a composite profile according to claim 8, whereby the insulating seal is at least partly formed by the second part of a thermal barrier.

15. The method according to claim 14, wherein the said sections are removed by making two cuts per section through the entire second part (14), then loosening the snap connector between the two cuts, and then removing the second part between the two cuts whereby the film hinge is cut or torn through.

* * * * *